US008511432B2

(12) United States Patent
Trant

(10) Patent No.: US 8,511,432 B2
(45) Date of Patent: Aug. 20, 2013

(54) SCAFFOLDING STAGE SUPPORT EXTENSION

(76) Inventor: Allan G. Trant, Hudson, NH (US)

( * ) Notice: Subject to any disclaimer, the term of this patent is extended or adjusted under 35 U.S.C. 154(b) by 171 days.

(21) Appl. No.: 12/775,621

(22) Filed: May 7, 2010

(65) Prior Publication Data

US 2011/0272212 A1 Nov. 10, 2011

(51) Int. Cl.
*E04G 5/00* (2006.01)

(52) U.S. Cl.
USPC ..... 182/129

(58) Field of Classification Search
USPC ..... 182/129; 248/210, 238
See application file for complete search history.

(56) References Cited

U.S. PATENT DOCUMENTS

| | | | | |
|---|---|---|---|---|
| 2,676,066 | A * | 4/1954 | Woboril, Sr. et al. | 182/113 |
| 3,605,944 | A * | 9/1971 | Rogers et al. | 182/82 |
| 3,717,220 | A * | 2/1973 | Donker et al. | 182/129 |
| 4,002,222 | A * | 1/1977 | Bruno | 182/132 |
| 4,598,794 | A * | 7/1986 | Anderson | 182/113 |
| 5,135,193 | A * | 8/1992 | Parris | 248/238 |
| 5,423,397 | A * | 6/1995 | Boughner | 182/107 |
| 5,746,288 | A * | 5/1998 | O'Neal et al. | 182/118 |
| 6,053,284 | A * | 4/2000 | Fountain | 182/180.2 |
| 6,557,667 | B1 * | 5/2003 | Ward | 182/129 |
| 6,840,350 | B2 * | 1/2005 | Deal | 182/82 |
| 2006/0196999 | A1 * | 9/2006 | Owens et al. | 248/210 |

* cited by examiner

*Primary Examiner* — Alvin Chin Shue
(74) *Attorney, Agent, or Firm* — Z IP Law PLLC; Claire Zopf

(57) ABSTRACT

A support extension for a scaffolding system to provide additional work area for storage of tools, brackets, trim, lumber, siding or other building materials and particularly to a set of staging insertions configured to match transom support tubing and extend laterally through a transom support and be secured to a staging member.

2 Claims, 10 Drawing Sheets

SCAFFOLDING STAGE SUPPORT EXTENSION

FIELD OF THE INVENTION

This invention relates to a support extension for a scaffolding system and more particularly to a set of staging insertions configured to extend laterally from a stage support and provide a work area for tool storage, brackets, trim, studs and siding.

BACKGROUND OF THE INVENTION

Scaffolding is a temporary structure designed to support workers, materials and tools during the construction and remodeling of buildings. Scaffolding is structurally comprised of tubes of aluminum, steel or composite materials, couplers and boards or stages that provide a working surface. The couplers are in the form of right angle couplers, putlog or swivel couplers to attach the tubes at end-to-end points using joint pins or by inserting tubes into one another using sleeve joints. Tubes are aligned vertically to form standards that transfer the entire mass of the structure to the ground. The standards rest on base plates that spread the load. A set of two standards are placed in parallel to a second set of two standards with horizontal tubes or ledgers extending between each of the two sets. Staging members may then be directly connected to the standards and/or supported by and upon the ledgers with one or more staging members aligned between each set of two standards.

The spacing of these basic elements within the scaffolding is fairly standard with the maximum bay length, the spacing between each set of two standards being 2.1 m (6.89 ft) or smaller depending upon the load. The scaffolding width is determined by the required work area with the minimum board width allowed being 0.60 m (1.97 ft), but may be up to 0.87 m (2.85 ft). The vertical spacing between the ledgers or lift height is between 2 m (6.56 ft) and 2.7 m (8.86 ft).

The staging may be formed from steel, aluminum or composite material and may be formed as a single unit. The staging member consisting of a top plank for the work surface and two support braces attached along each edge of the plank. It is common practice within the industry, to add additional support and stability to the staging member by integrating transoms extending between the support braces. The transoms may be formed by inserting square or round tubes or metal bars through aligned holes within each of the opposing support braces. To reduce weight and costs of the staging member, the transoms may be hollow piping or square, hexagonal, channel or angled steel or aluminum stock. Each transom bar may be laterally spaced at distances of 0.15 m (0.5 ft) to 0.46 m (1.5 ft) along the staging to provide structural support.

For most scaffolding used on two to three story buildings the board or stage width is between 0.61 m (2 ft) to 0.91 m (3 ft) and pre-constructed staging members with braces and transoms can be procured in standard widths within this range. Each staging unit has a load support rating that limits the weight of workers or materials that may be supported on that staging. Typically, two sets of staging members are used with the first being a main support stage with a higher load rating and the second being a work bench with a lower rating. The main support stage may be attached to a first set of the two standards and extends in a lateral direction along the ledgers. The work bench staging extends parallel to and at a lift height approximately 0.91 m (3 ft) higher than the main support, rising above and behind the work area. A safety net may then be extended from the work bench to the main support to aid in the prevention of workers or materials falling from the scaffolding.

The work area along the main support staging is a limited area for workers to maneuver and for storage of materials, hardware and tools. Efficient work also requires easy access to tools, materials and hardware to fit, align and secure studs, framing, trim board, siding or windows to the building structure. A need exists for a durable safe support storage system to provide more efficient access for workers and that meets the standard requirements and specifications of existing scaffolding elements and structures.

OBJECTS AND SUMMARY OF THE INVENTION

The present invention is a support extension providing workspace for tool and material storage without adding additional staging, board or planking to the scaffolding system. One or more of the support extensions may be affixed to or inserted through the staging portion of the scaffolding. The extensions form a lateral support at every 0.15 m (0.5 ft) to 0.46 m (1.5 ft) of staging and allow material or tools to be straddled along, draped between or hung from one or more of the extensions.

The support extension may be formed of standard steel, aluminum tubing or channel stock or a high-density composite or plastic and is configured in square, round, hexagonal or other shapes to accommodate standard transom shapes and diameters. The support extension is inserted in the hollow diameter of the transom and extends through each of the first and second support braces. One or more openings on one end of the extension allow a joint pin to be inserted through the end of the extension preventing removal of the extension from the brace/transom/stage support. A cap stop or plug surrounds or is inserted through an opening in a portion of the extension preventing insertion of the extension beyond the substantial length of the transom, thus preventing damage to the building siding or windows. A number of openings along the insertion tip of the support extension or a slot for the plug or cap stop may allow for the extension to accommodate different widths of staging by providing for various lengths of insertion through the transom support. A wider staging plank would reduce the length of the cantilever of the support extension but the present invention would be designed to provide a minimal lateral distance of 0.15 m (0.5 ft) to 0.25 m (0.83 ft) in using the extension with a staging plank of a width 0.76 m (2.5 ft) to 0.91 m (3 ft).

The support extension may include a round or square edge plate or vertical bar that prevents material such as wooden studs, trim board or siding from rolling or sliding off of the extension. The vertical portion may also be a hollow tube allowing tools to be inserted partially in or hung from the extension for safe and easy access. An adhesive wrap or foam cushion may surround a portion of the lateral support extension or the vertical bar or plate. The support extension would not be designed to support the weight of a worker and load ratings with safety warnings and labeling would be important features of the invention.

It is an object of the present invention to form a support extension that is compatible with and meets the standard requirements of common staging and scaffolding boards and platforms.

It is another object of the invention to provide an extended work area for tools, hardware and materials.

It is another object of the invention to form the support extension of standard steel stock, aluminum stock or other light weight materials that match the shapes and dimensions of standard transom supports and staging.

It is another object of the invention to provide lateral support from the staging and a vertical plate or bar preventing materials or tools from rolling or sliding from the support extension.

It is a further object of the present invention to provide the lateral support of the support extension within a safety net.

It is a still further object of the present invention to provide one or more apertures within the support extension to provide for the hanging of tools or hardware from the support.

The present invention is directed to a support extension for a scaffolding system comprising a plurality of lateral extenders dimensionally shaped to conform to a transom support of a stage member and a plurality of locking mechanisms wherein one of the plurality of locking mechanisms affixes to one of the plurality of lateral extenders extended through the transom support securing the extender to the staging member of a scaffolding system The present invention is also directed to a scaffolding system for supporting workers, tools and materials at a desired height relative to another object, the scaffolding system comprising a plurality of standards supporting a stage upon which the workers may be supported, a plurality of transom supports formed with the stage and defining a plurality of respective passages extending from a first side of the stage to a second side of the stage, and a lateral support having a first portion sized to be received inside the passages defined by the transom supports, the first portion defining a supporting plane upon which materials may be supported adjacent the stage, and the lateral support having a second portion connected to the first portion defining a surface aligned at substantially ninety degrees to the supporting plane.

The present invention is further directed to a method for extending the work area of a scaffolding system comprising dimensionally forming a lateral extender in the shape of a transom port of a staging member, inserting the lateral extender through the transom port, and securing the lateral extender to the staging member. These and other features, advantages and improvements according to this invention will be better understood by reference to the following detailed description and accompanying drawings.

DETAILED DESCRIPTION OF THE INVENT

Figure 1:
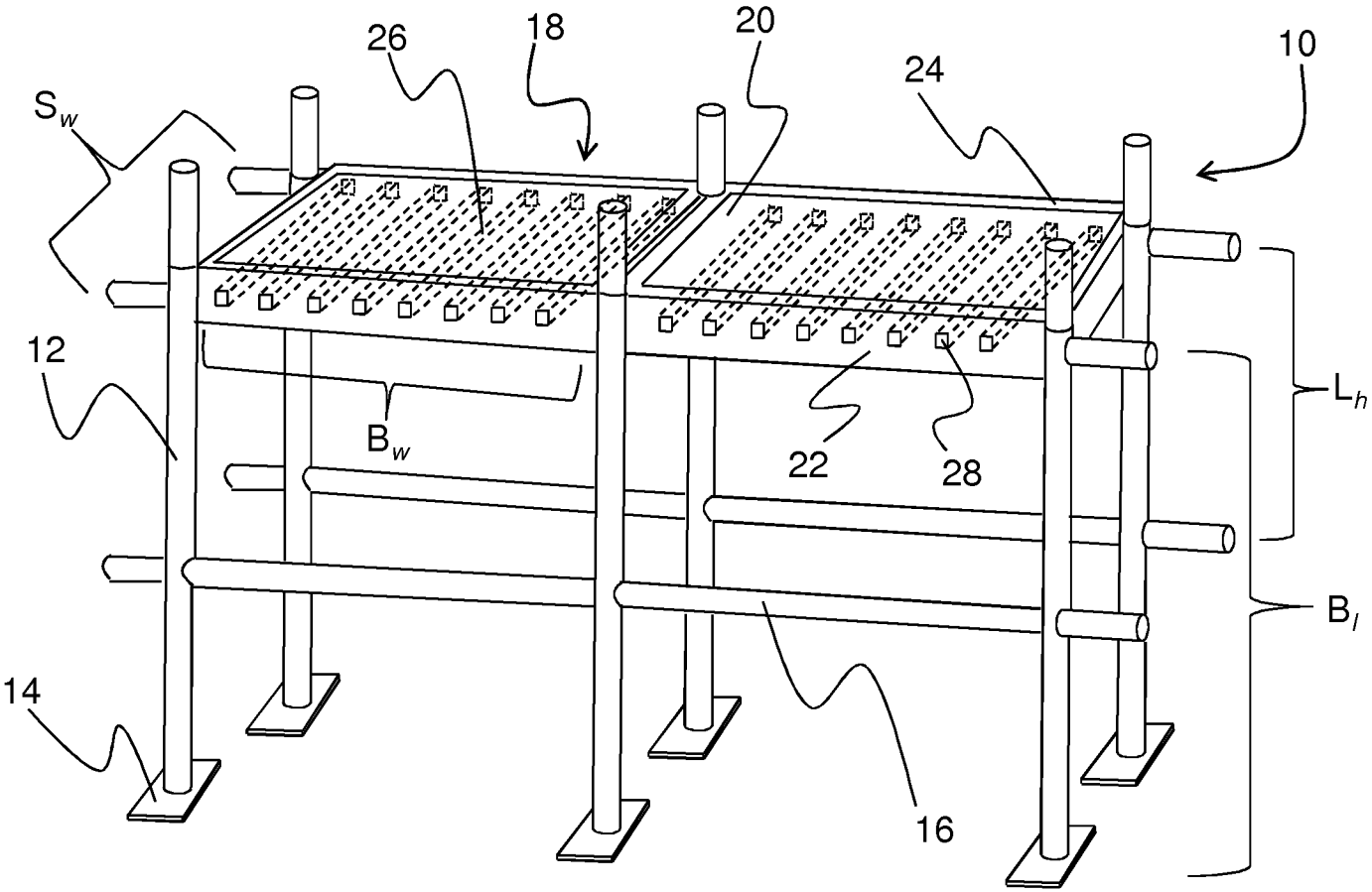
FIG. 1 is a perspective view of a scaffolding system.

The elements of one type of scaffolding system 10 are shown in FIG. 1. The system includes a set of standards 12 and ledgers 16. The standards 12 are supported on a set of base plates 14 with the ledgers 16 extending between the standards 12 to support the staging 18. The vertical distance from the base plate 14 to the staging 18 is the base lift $B_l$ and the vertical distance between each set of ledgers 16 is the lift height $L_h$. The staging 18 as a single unit or as components is placed between a set of standards 12 within the bay with the length of the staging 18 accommodating the bay width $B_w$. The width of the staging 18 matches the scaffolding width $S_w$. The staging member 18 may be comprised of a first and second brace support 22, 24 that straddles the ledgers 16 and board or planking 20 lying across the top of the brace supports 22, 24. A set of transoms 26 extend between the first and second base supports 22, 24 providing strength and stability to the staging 18. The transoms 26 are commonly formed from hollow square or round stock of steel or aluminum to reduce the weight of the staging member 18. The transom ports 28 provide an opening for the present invention to be inserted through and extend from. The support extension 30 of the present invention is configured to match the shape and be slightly smaller in dimension to the transom port 28 so as to securely fit within and through the port 28.

Figure 2:
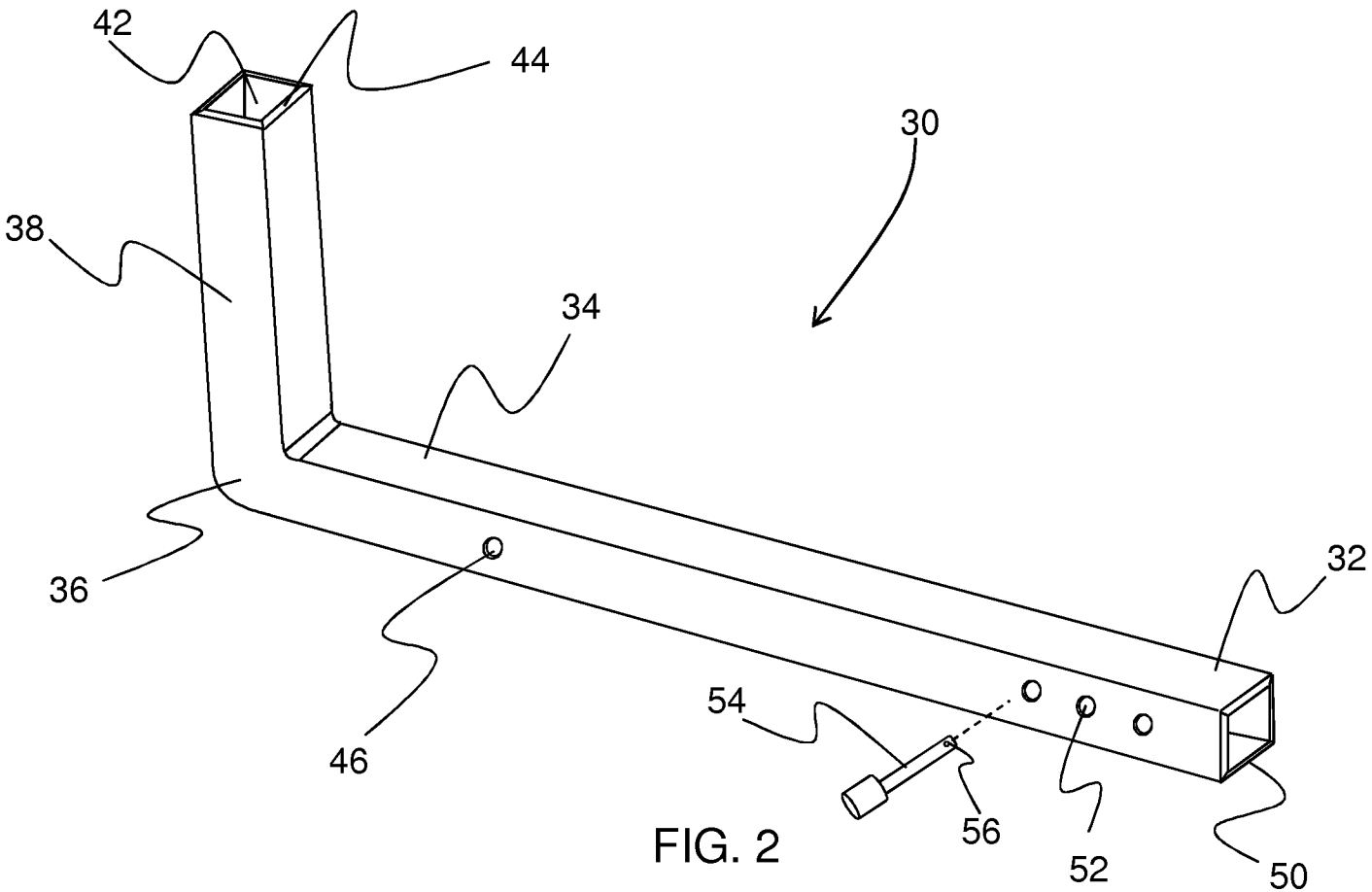
FIG. 2 is a perspective view of a first embodiment of the support extension.
Figure 8:
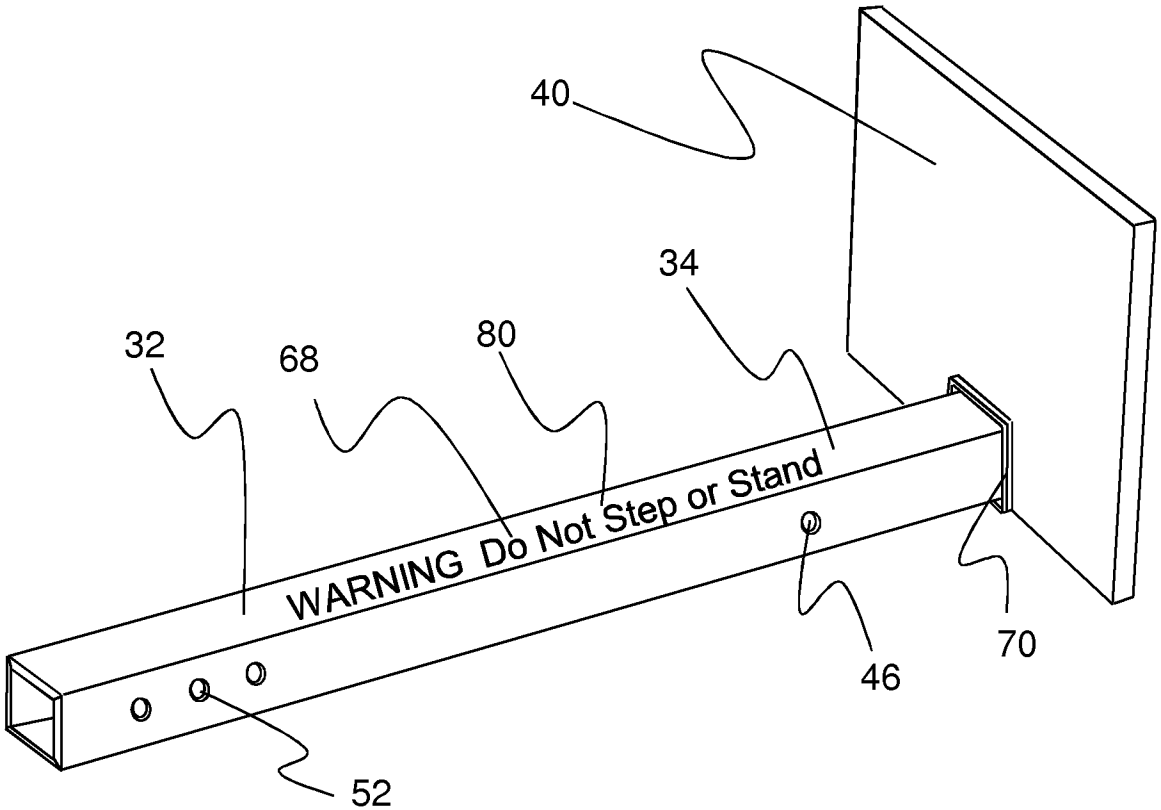
FIG. 8 is a further embodiment of the support extension.

A perspective view of a first embodiment of the support extension 30 formed from steel or aluminum square stock is shown in FIG. 2. The support extension 30 comprises a tip 32, cantilever 34, elbow 36 and edge bar 38 or bracket and edge plate 40 as shown in FIG. 8. The support 30 may be hollow with an opening 42 at the end of the edge bar 38 to allow a tool handle, bracket or other hardware to be inserted and hung over the edge bar 38. A bevel 44, and or a foam or rubber cushion 45 may be placed around the edge of the opening 42 to prevent injury or damage to tools. An opening or recess 46, cap stop 47 (shown in FIG. 3) or slot 48 (shown in FIG. 4) is positioned along the cantilever 34 at a distance from the tip end 50 greater than the scaffolding width $S_w$. A cap plug or pin 54 or bolt 62 is placed through the opening or slot to stop insertion of the support extension at a point greater than the scaffolding width $S_w$. Along the tip 32 of the support extension 30 a locking pin insert opening or recess 52 is positioned at a distance from the stop pin opening 46 greater than the scaffolding width $S_w$. One or more locking pin openings 52 may be positioned along the tip 32 of the support extension 30 to accommodate various scaffolding widths $S_w$ and allow for the same extension support 30 to be used with scaffolding of different dimensions. A locking pin 54 is shown in FIG. 2 and is inserted through the locking pin opening 52 after installation of the support extension 30 through the staging transom 26. A nail or cap pin (not shown) is inserted through an aperture 56 on the end of the locking pin 54 to secure the locking pin 54 in place and prevent the removal of the support extension 30 from the transom 26 without removal of the locking pin 54 thereby securing the support extension 30 in place within the transom 26.

Figure 3:
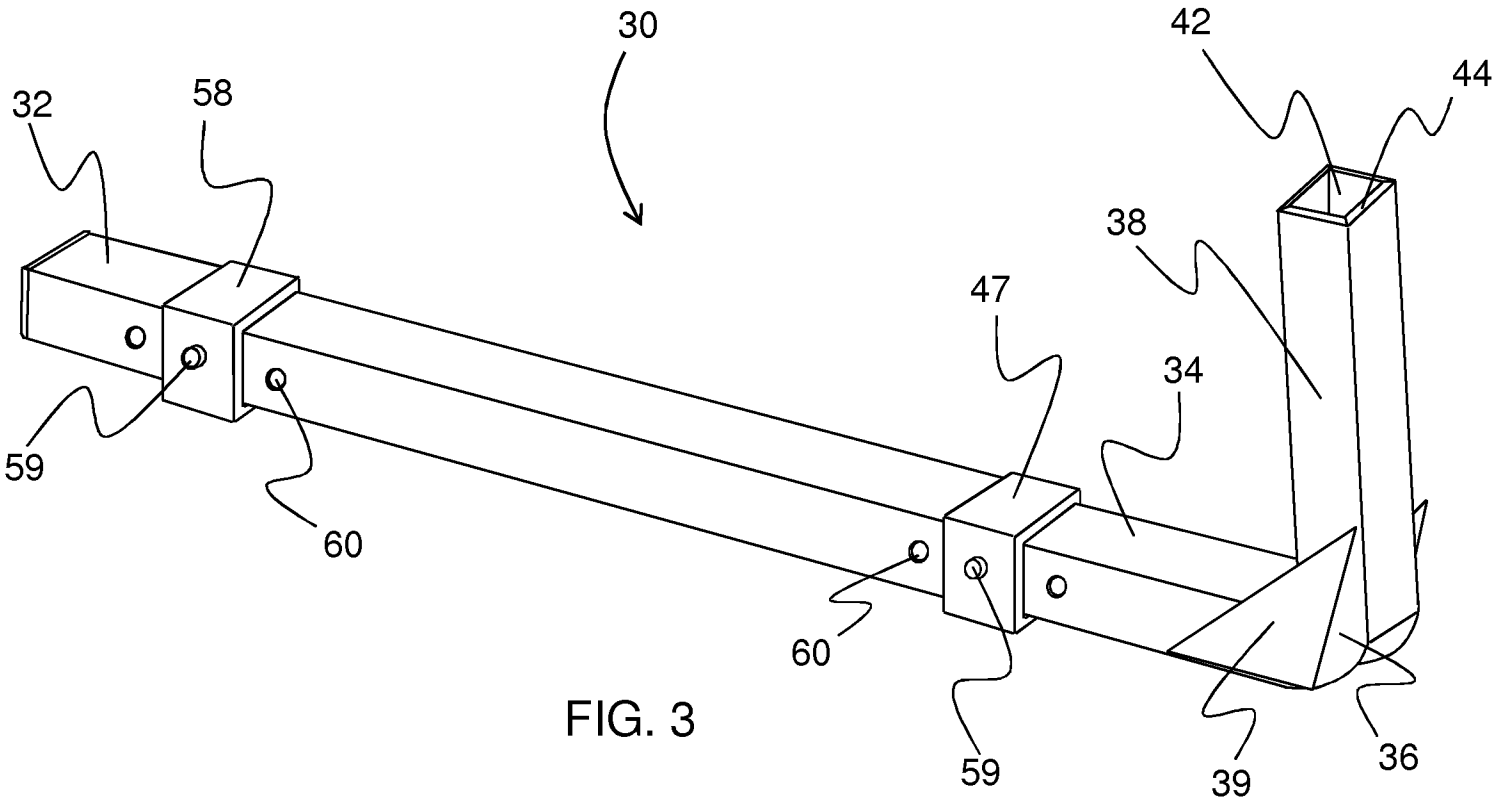
FIG. 3 is second perspective view of the first embodiment of the support extension with a cap stop and locking cap.
Figure 4:
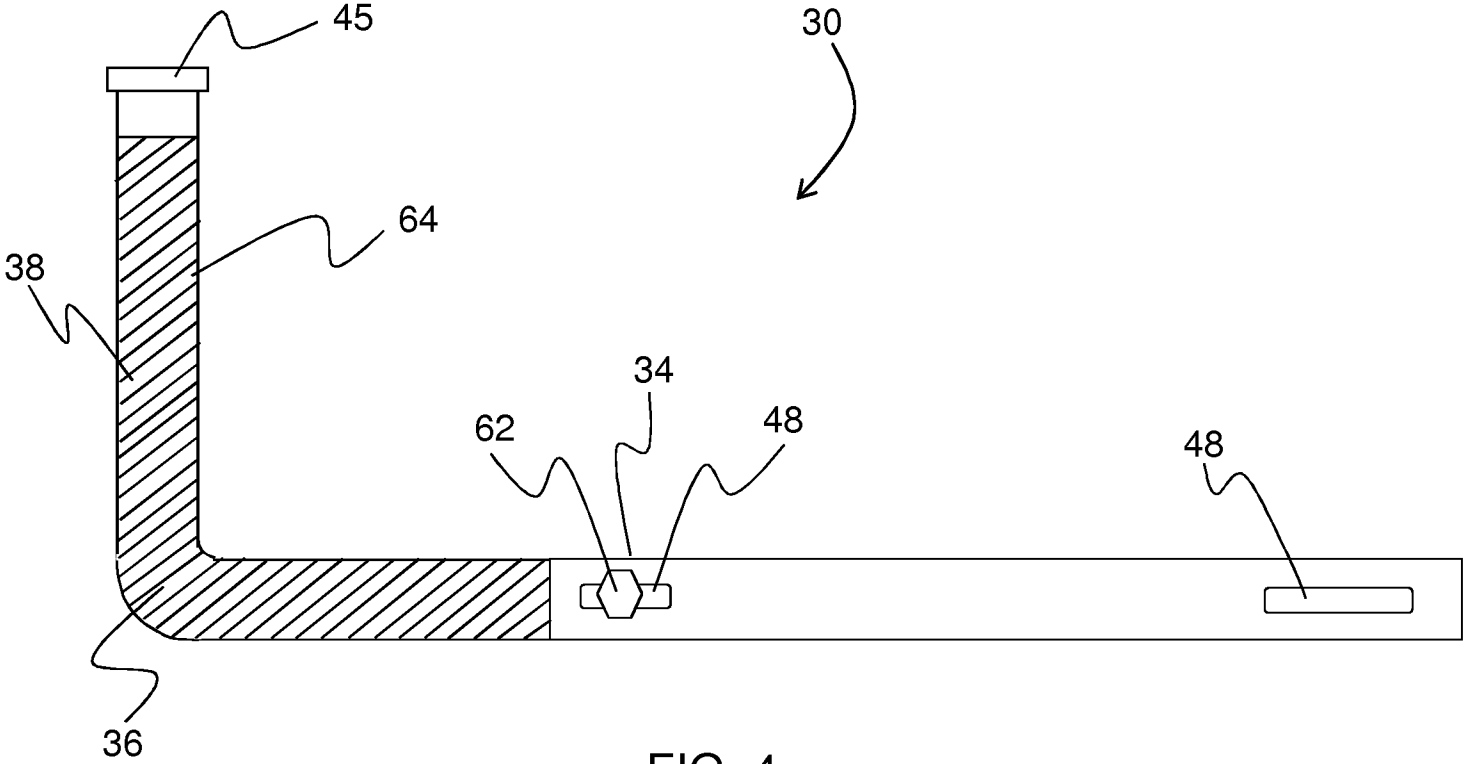
FIG. 4 is a side view of the first embodiment of the support extension with slots and protective wrap.

An alternative to a locking pin as shown in FIG. 3 is a locking cap 58 with a detent 59 and recess 60. The locking cap 58 may be slid over the tip of the support extension 30 after inserting the support extension 30 through the transom 26. By applying pressure to the detent 59 and then releasing pressure at one of the one or more recess ports 60 the support extension 30 may be locked in place within the transom 26. A cap stop 47 may also implore a detent 59 and one or more recess ports 60 to prevent the extension support 30 from being inserted beyond a minimal distance through the scaffolding thereby preventing damage to a wall or building structural surface. The position of one or more of the recess ports 60 of the locking cap 58 are at a distance from the recess ports 60 of the cap stop 47 greater than the scaffolding width $S_w$ as described above. In a further embodiment, as shown in FIG. 4 a slot 48 through the cantilever 34 may allow adjustment of a bolt 62 extended through the slot 48 of the support extension 30 to prevent the support extension 30 from being inserted to far through the transom 26 of the staging member 18. The bolt 62 may be tightened using a nut and washer. A slot 48 through the tip 32 of the support extension 30 may also be applied to lock the support extension 30 in place within the transom 26 using the bolt and nut assembly. The cantilever 34 and edge bar 38 of the support extension 30 may be surrounded with a wrap adhesive, foam cushion or rubber grip solution 64 that is glued, sprayed or rolled onto the support extension 30 to protect scratching or damage to materials or tools placed along or supported by the support extension 30.

Figure 5:
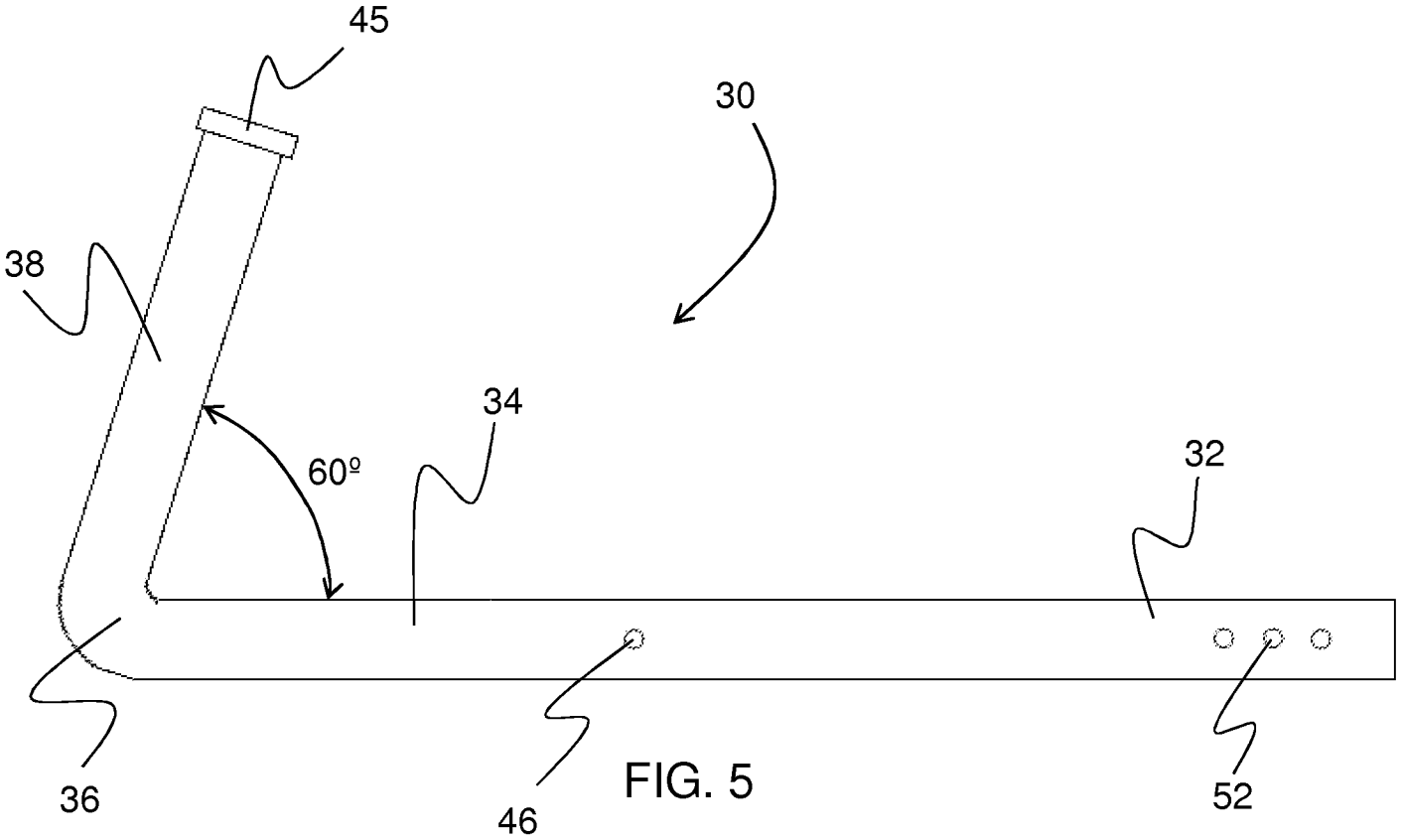
FIG. 5 is a side view of a second embodiment of the support extension.

The support extension 30 may be formed from a single piece of square stock cut to a length between 0.81 m (2.67 ft) and 1.22 m (4 ft). For a piece cut to 0.91 m (3 ft) a measurement of 0.25 m (0.83 ft) is taken from either end of the square stock and an elbow 36 and a vertical edge bar 38 are formed by folding the material at this point. The elbow may be at 90° as shown in FIGS. 2-4, or be at an angle of approximately between 60° and 90° as shown in FIG. 5. The formation of the elbow 36 at an angle smaller than 90° provides for a narrower region to slide and secure trim or siding material against. The elbow 36 and vertical edge bar 38 may also be formed by making two cuts in the material each approximately at a 45° angle at or near the measured point and having the cuts intersect without cutting through the material. The cut portion of the material is removed and the piece is folded to form the vertical edge bar 38. An angle bracket 39 may then be welded to each side of the support extension 30 at the elbow 36 to hold the position of the vertical edge bar 38 as shown in FIG. 3.

Figure 6:
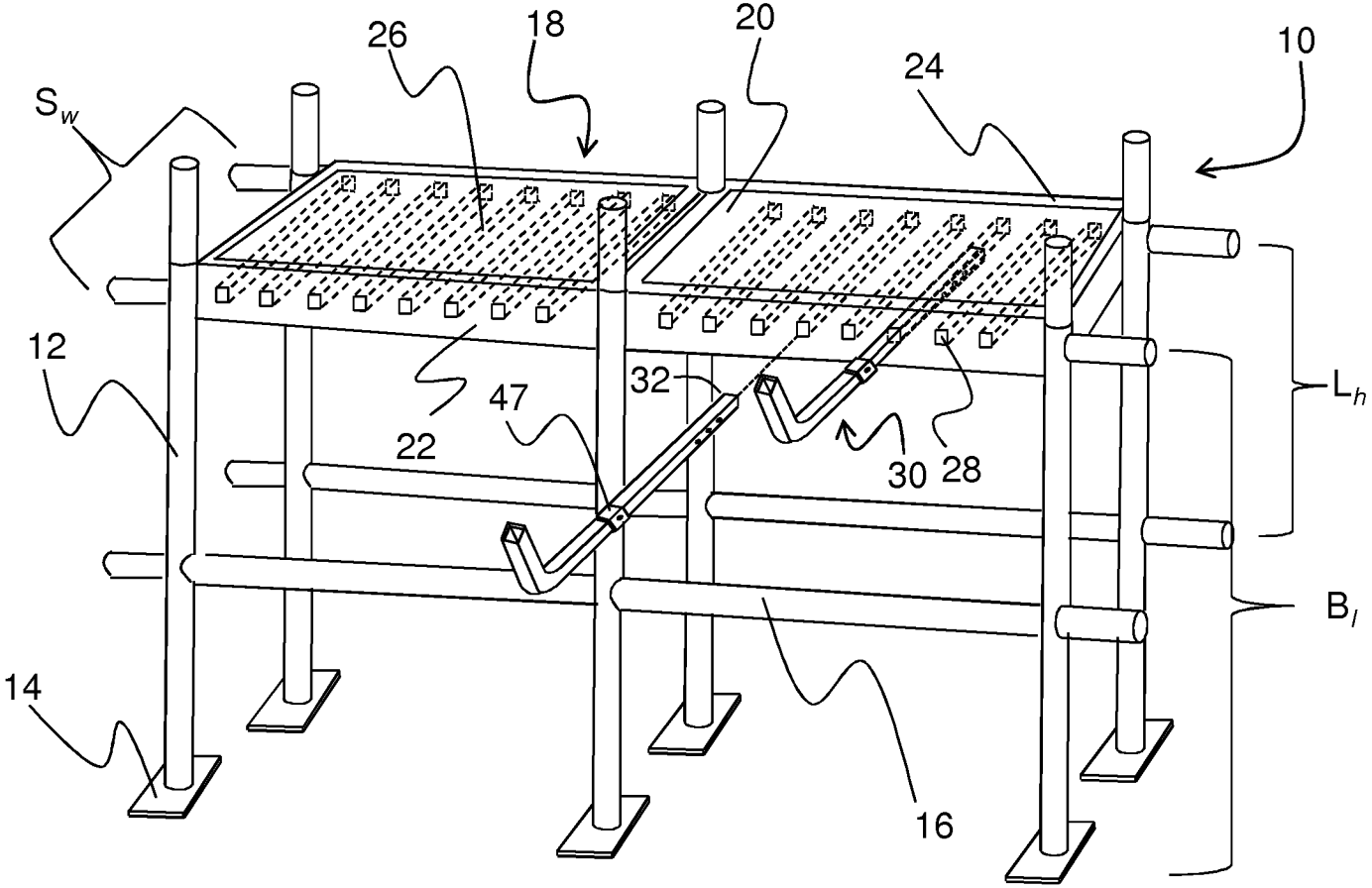
FIG. 6 is the first embodiment of the support extension and a scaffolding system.
Figure 7:
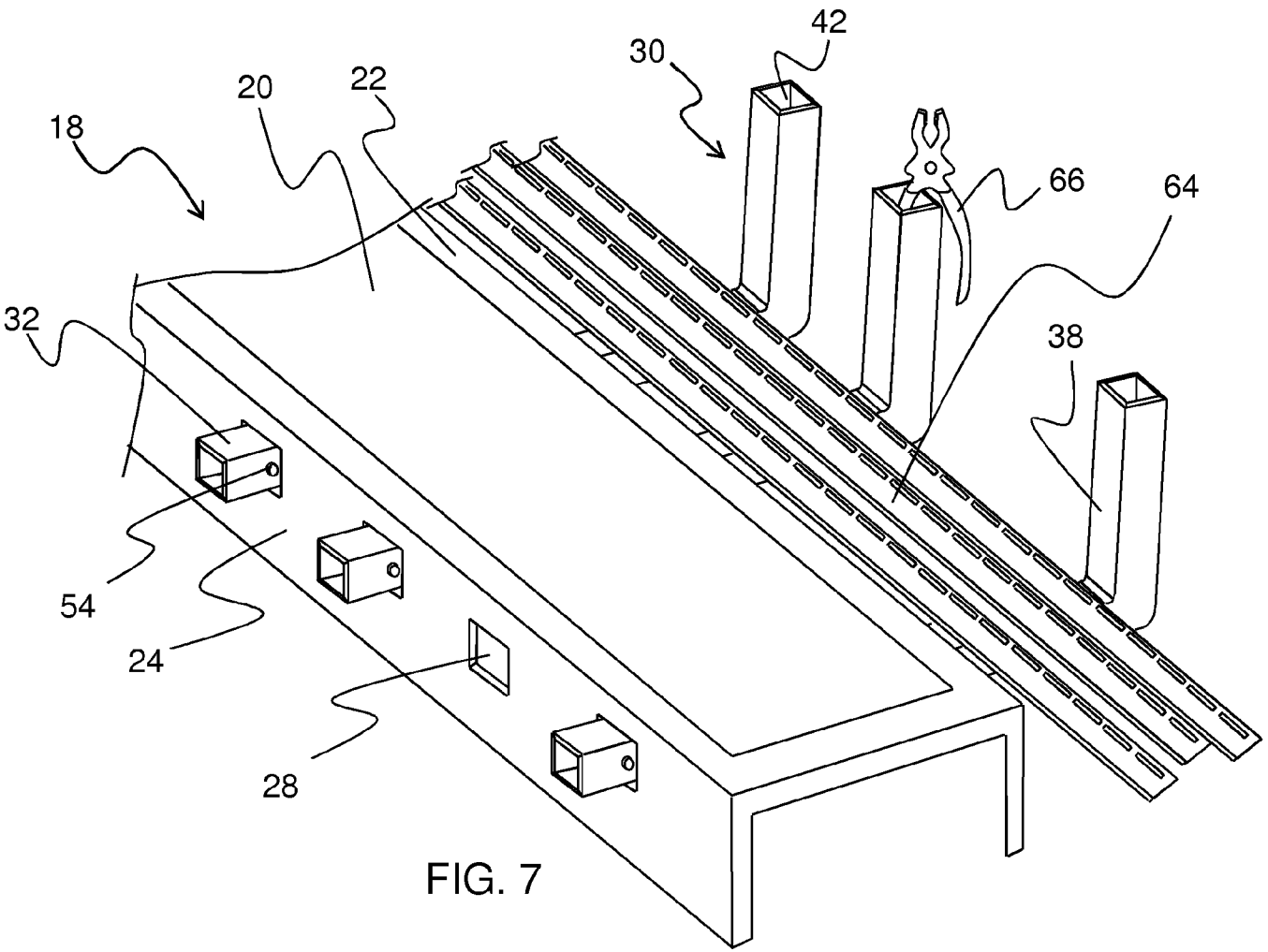
FIG. 7 is the first embodiment of the support extension inserted through a transom support.

In either embodiment as shown in FIG. 6, the tip 32 of the support extension 30 is aligned with and slid into the transom port 28 to or near the point of contact of the cap stop 47 with the brace support 22 so that the tip 32 extends partially from the transom port 28 of the opposing brace 24 as shown in FIG. 7. A locking pin 54 or locking cap 58 is secured to the tip 32 of the support extension 30 preventing removal of the extension 30 from the transom port 28 without removal of the locking pin 54 or cap 58. One or more support extensions 30 may be installed along the staging 18 to accommodate and support the length of a building material 64 such as lumber, trim or siding, or to provide improved access to tools 66 or hardware. The support extension allows building materials, tools and hardware to be removed from the boards or planking work surface 20 of the staging 18 improving safety as workers are not mis-stepping or weaving in trying to avoid laid out tools or material as they maneuver along the work surface. Work efficiency is also improved as stretching or overreaching for misplaced tools is avoided. The support extension 30 may be installed from the work surface by sitting or kneeling perpendicularly to the work surface 20 and inserting the support extension 30 into the transom port 28. By rotating around to the opposing brace, the locking cap 58 or pin 54 may also be easily installed securing the support extension 30 in place. A safety net (not shown) would hang below and under the staging member 18 and would not be interfered by the installation of one or more the support extensions 30. The net would also provide a catching surface if a support extension 30, cap 58 or pin 54 was accidentally dropped during installation.

Figure 9:
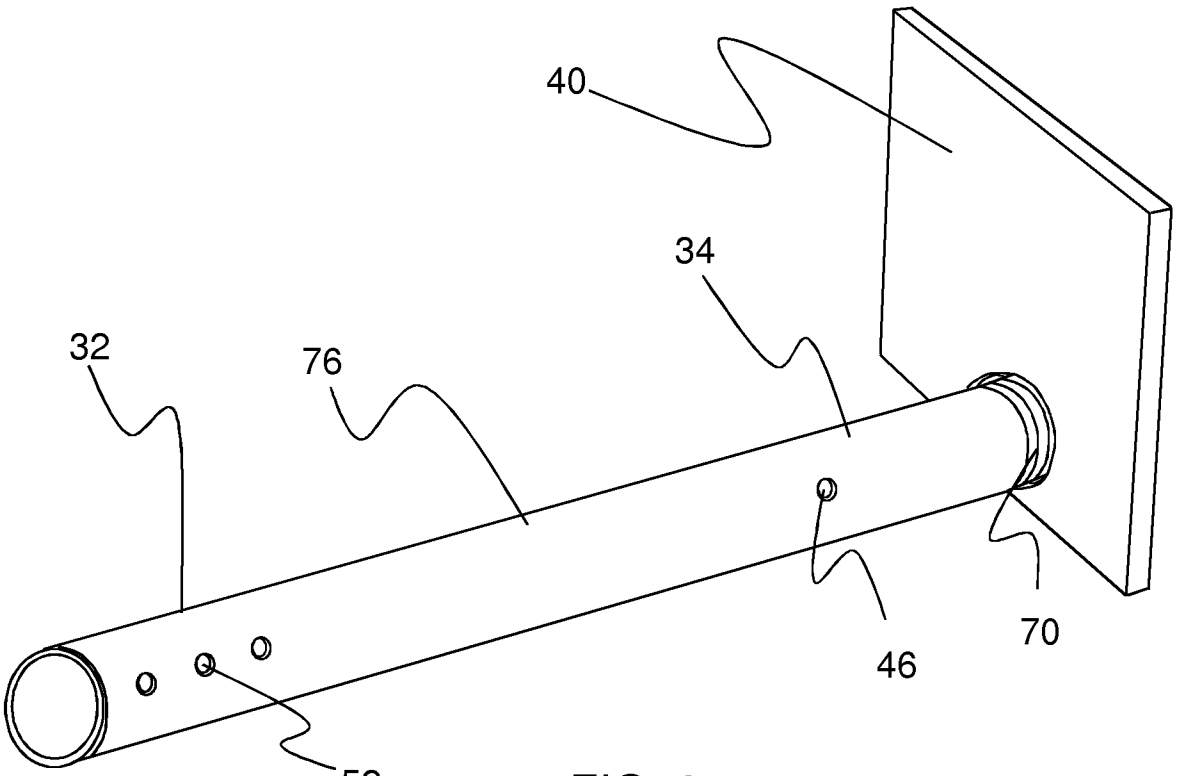
FIG. 9 is a still further embodiment of the support extension.
Figure 10:
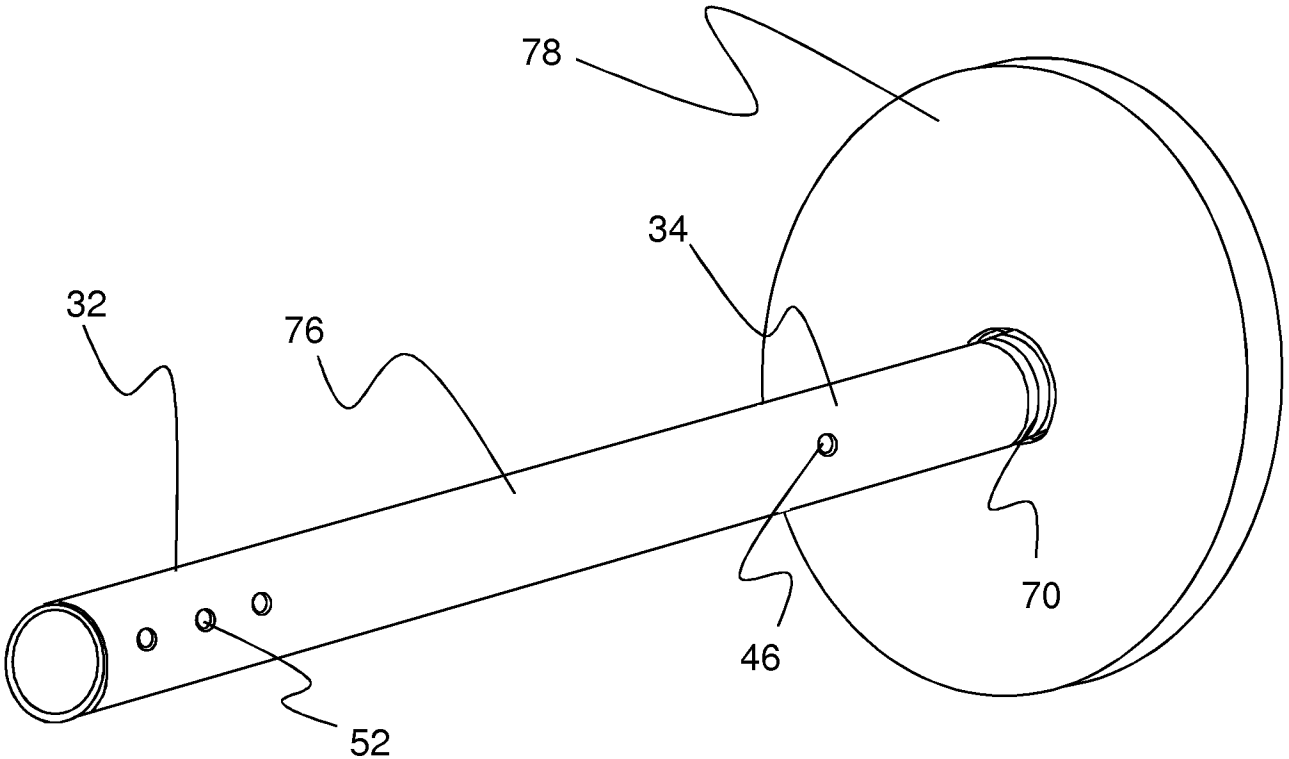
FIG. 10 is a still further embodiment of the support extension.

Further embodiments of the support extension are shown in FIGS. 8-10. As shown in FIG. 8, steel or aluminum square stock could be used, but instead of forming an elbow by folding the stock, an edge plate 40 may be affixed to the square stock 68 using a collar bracket 70. The edge plate 40 would provide a larger surface area to help prevent dropping of material from the support extension and allow a larger load of material to be supported. A warning label 80 may be affixed to the cantilever clearly denoting that the support extension is not intended to support the weight of a worker and should not be stepped or stood upon. Similarly, the embodiments of FIGS. 9 and 10 show the use of round stock 76 with a square edge plate 40 or round edge plate 78 using a collar bracket 70. The use of standard materials that require only the attachment of a plate and bracket greatly reduces the manufacturing costs and tooling mechanisms needed to produce the present invention. The plate attachment 40 may be in a square or rectangular configuration as shown in FIG. 9 or a round plate 78 as shown in FIG. 10. The openings or recess ports for a stop pin, plug or cap and a locking pin, plug or cap are similar to those features as described above. The material selected and shape of the support extension is determined by the standard dimensions and shape configurations of the staging transoms 26. Channel stock, I-Bar, hexagonal, triangular or other shapes may be used, with the formation of an edge bar or plate dependent upon the material selected. The support extension may also be of composites of ceramic or plastics or other materials that can provide the lateral strength and required support of the weight of the building materials used. None of the presented embodiments are intended to in any way limit the scope of the present invention.

Since certain changes may be made in the above-described invention, without departing from the spirit and scope of the invention herein involved, it is intended that all of the subject matter of the above description or shown in the accompanying drawings shall be interpreted merely as examples illustrating the inventive concept herein and shall not be construed as limiting the invention.

What is claimed is:

1. A support extension for a scaffolding system comprising;

a stage member having a plurality of transom supports extending between opposing sides of the stage member a plurality of L-shaped lateral extenders, each extender formed from a single piece of hollow stock and having a folded elbow extending at an angle of between 60 and 90 degrees to a horizontal leg of the L-shaped lateral extender and having an outer dimension shaped to match an inner diameter shape of a passage defined by the transom support; a first and a second locking mechanism connected solely to the horizontal leg of the lateral extenders;

the first locking mechanisms comprising a plurality of openings at a free end of the horizontal leg with a pin selectively inserted into one of the plurality of openings and is axially adjustable along the horizontal leg of the lateral extender to accommodate different widths between the opposing sides of the stage member;

the horizontal leg of the lateral extender extends beyond the entire width of the stage member forming an extended work area between the folded elbow and the second locking mechanism with each of the plurality of lateral extenders; the matching outer dimension shape of the extender with the inner diameter shape of the transom support passage maintains the lateral extension in a predetermined radial relationship with the transom support passage; the second locking mechanisms comprises a stop pin inserted radially through the lateral extender to appropriately align the lateral extender relative to the width of the stage member of the transom support; and wherein the folded elbow being a vertical leg of the lateral extender and forms a stop member, the stop member defining at a free end an opening to provide a storage location for tools or hardware; wherein the matching outer dimension shape of the extender with the inner diameter shape of the transom support passage are each provided with a corresponding angular profile limiting relative rotation between the lateral extender and the transom support passage.

2. The support extension for a scaffolding system as set forth in claim 1 wherein the corresponding angular profile limiting relative rotation between the lateral extender and the transom support passage during engagement is substantially a square shape.

* * * * *